United States Patent [19]

Tubbs et al.

[11] Patent Number: 4,557,839

[45] Date of Patent: Dec. 10, 1985

[54] SYNERGISTIC LUBRICANT ADDITIVES OF ANTIMONY THIOANTIMONATE AND MOLYBDENUM DISULFIDE OR GRAPHITE

[75] Inventors: Paul Tubbs, Philadelphia; James King, Lansdale, both of Pa.

[73] Assignee: Pennwalt Corporation, Philadelphia, Pa.

[21] Appl. No.: 685,196

[22] Filed: Dec. 21, 1984

[51] Int. Cl.[4] ..... C10M 1/54

[52] U.S. Cl. ..... 252/23; 252/25; 252/29; 252/30

[58] Field of Search ..... 252/23, 18, 29, 30, 252/25

[56] References Cited

U.S. PATENT DOCUMENTS

| | | | |
|---|---|---|---|
| 3,935,114 | 1/1976 | Donaho, Jr. | 252/25 |
| 3,965,016 | 6/1976 | Soulen | 252/25 |
| 4,465,604 | 8/1984 | King | 252/25 |
| 4,473,481 | 9/1984 | Fukutsuka et al. | 252/30 |

OTHER PUBLICATIONS

ASLE Proceedings, W. J. Bartz et al., "A Study on the Behaviour of Bonded Lubricating Film Containing Molybdenum Disulfide ($M_0S_2$), Graphite and Antimony-Thioantimonate ($Sb(SbS_4)$)", Aug. 1984, pp. 88–97.

*Primary Examiner*—Jacqueline V. Howard

[57] ABSTRACT

Complex sulfides of antimony combined with either molybdenum disulfide or graphite are used as mixtures to impart synergistic effects in imparting extreme pressure and antiwear properties to lubricants.

7 Claims, No Drawings

SYNERGISTIC LUBRICANT ADDITIVES OF ANTIMONY THIOANTIMONATE AND MOLYBDENUM DISULFIDE OR GRAPHITE

BACKGROUND OF THE INVENTION

This invention relates to lubricant compositions containing a mixture of antimony thioantimonate ($SbSbS_4$) and molybdenum disulfide ($MoS_2$) or graphite with lubricating materials for imparting extreme pressure and antiwear properties to the lubricant composition.

Antimony thioantimonate ($SbSbS_4$) is known as a lubricant additive in oils and greases wherein the additive concentration is 1–60% of the composition (U.S. Pat. No. 3,965,016).

It is known that certain materials of lamellar crystal structure such as molybdenum disulfide and graphite can impart lubricating properties to greases, solid films, and other configurations in which they are employed. U.S. Pat. No. 3,935,114 discloses the use of molybdenum disulfide and a selected class of metallic oxides such as antimony trioxide in effective and synergistic amounts for use as lubricant additives.

The synergistic mixture of the instant invention has not been found in the prior art.

SUMMARY OF THE INVENTION

This invention is directed to a lubricating composition consisting essentially of, based on the weight of the composition, from about 60 to about 99.8% of a lubricant selected from the group consisting of a grease, a mineral oil of lubricating viscosity, and a synthetic fluid of lubricating viscosity, and a synergistic mixture of from about 0.1 to about 20% of $SbSbS_4$ and from about 0.1 to about 20% of $MoS_2$ or graphite or mixtures thereof, wherein said $SbSbS_4$ and $MoS_2$ or graphite are mixed in a synergistic ratio in the range of 1 to 9 to 9 to 1, preferably 1 to 3 to 3 to 1.

DETAILED DESCRIPTION OF THE INVENTION

The extreme pressure (EP) and antiwear additives embodied in the synergistic mixture of the present invention generally are incorporated in lubricant compositions in a particulate form, i.e., as a finely divided powder having a particle size in general, within the range from about 0.01 microns to about 100 microns, and preferably within the range of from about 0.1 to about 10 microns.

The composition of this invention is useful for lubricating the contacting surfaces of a wide variety of materials, for example, metals such as steel, molybdenum, zinc, copper, bronze, brass, Monel and other metals and metal alloys, plastics, ceramics, graphite, and other materials, wherein the contacting surfaces may be of the same or different materials. The most important of these compositions are oil and grease compositions having improved extreme pressure and load-carrying ability which are prepared by incorporating in a conventional oil or grease from about 0.2 to about 40% by weight of the synergistic mixture of this invention, preferably from about 1.0% to about 20% by weight of the composition.

The conventional grease can be a natural petroleum grease (which may contain small amounts of antioxidants, anticorrosives, or other additives) or a synthetic grease. The synthetic grease is comprised of a synthetic fluid (such as dioctyl sebacate, dioctyl adipate, tributyl phosphate, di-2-ethylhexyl sebacate, ditridecyl phthalate, ditridecyl adipate, dioctyl dimerate, trimethylolpropane tripelargonate, pentaerythritol tetravalerate, triaryl phosphate, polyalkylene ethers, polyalphaolefins, and the like), from about 5% to about 45% of a thickener) such as lithium stearate, aluminum stearate, lithium hydroxy stearate, calcium stearate, silica, clay, hydroxyaluminum benzoate stearate, polyureas, and the like), and small amounts of other additives (such as antioxidants and anticorrosion agents). Other greases which are improved by the synergistic mixture of this invention are silicone greases comprised of a silicone oil containing a thickening agent such as tetrafluoroethylene polymers and copolymers, other fluoropolymers, or fumed silica.

The synergistic mixture also finds use as a component for the lubricating dispersion comprising a liquid oil carrier having lubricating viscosity such as a hydrocarbon oil, synthetic ester oil, synthetic polyether oil, or silicone oil containing therein from about 0.2% to about 40% by weight of the solid synergistic mixture particles, preferably from about 1.0% to about 20% by weight based on a total weight of dispersion.

Antimony thioantimonate complex may be prepared by the method described in U.S. Pat. No. 3,965,016 which is herein incorporated by reference.

The following examples are provided to further illustrate the present invention in which the antimony thioantimonate and molybdenum disulfide or graphite synergistic mixtures were prepared and tested as lubricant mixtures with greases and oils of lubricating viscosity.

EXAMPLES 1 THROUGH 7

A silica grease derived from a synthetic polyalphaolefin base fluid thickened with silica was separately blended with different mixtures of $SbSbS_4$ and $MoS_2$ as shown in Table I below. The blended greases were evaluated by means of Shell Four-Ball EP and Wear testers. The experimental results are recorded in Table I. The wear scar diameters, load wear indexes and weld points of the greases containing different ratios of $SbSbS_4$ and $MoS_2$ are superior to those of the greases containing either $SbSbS_4$ or $MoS_2$ alone.

TABLE I

Shell Four-Ball Lubricating Properties of Silica Grease[1] Containing Various Additives

| Example No. | 1 | 2 | 3 | 4 | 5 | 6 | 7 |
|---|---|---|---|---|---|---|---|
| $Sb_2S_4$ | 0 | 10 | 7.5 | 6.7 | 5.0 | 3.3 | 0 |
| $MoS_2$[3] | 0 | 0 | 2.5 | 3.3 | 5.0 | 6.7 | 10 |
| Scar Dia., $mm^2$ | 0.81 | 0.72 | 0.56 | 0.52 | 0.53 | 0.52 | 0.63 |
| Weld Pt., kg | 126 | 400 | 500 | 500 | 500 | 400 | 250 |
| Load Wear Index | 33 | 100 | 111 | 111 | 113 | 107 | 35 |

[1]Polyalphaolefin oil thickened with silica.
[2]1200 rpm, 40 kg and 167° F. for one hour (AISI 52100 steel balls).
[3]Technical fine grade.

EXAMPLE 8 THROUGH 12

Using the same procedure as described in Example 1–7, silica grease was separately blended with different mixtures of $SbSbS_4$ and graphite as shown in Table II below. The performance data of scar diameters, load wear indexes and weld points are listed in Table II. The greases containing mixtures of $Sb_2S_4$ and graphite show superior performance to those of greases containing either $SbSbS_4$ or graphite alone.

TABLE II

Shell Four-Ball Lubricating Properties of Silica Grease[1] Containing Various Additives

| Example No. | 8 | 9 | 10 | 11 | 12 |
|---|---|---|---|---|---|
| $Sb_2S_4$ | 10 | 7.5 | 6.7 | 5.0 | 0 |
| Graphite[3] | 0 | 2.5 | 3.3 | 5.0 | 10 |
| Scar Diameter, mm[2] | 0.72 | 0.52 | 0.47 | 0.74 | 0.86 |
| Weld Pt., kg | 400 | 400 | 500 | 400 | 200 |
| Load Wear Index | 100 | 87 | 86 | 80 | 39 |

[1]Polyalphaolefin thickened with silica.
[2]1200 rpm, 40 kg, and 167° F. for one hour (AISI 52100 steel balls).
[3]Graphite powder with an average particle size of 50μ.

EXAMPLES 13 THROUGH 15

A bright stock mineral oil of 2600 SUS viscosity at 100° F. was separately blended with 0.5% $Sb_2S_4$, 0.25% $Sb_2S_4$/0.25% $MoS_2$, and 0.5% $MoS_2$ using a high speed mechanical stirrer. The Shell Four-Ball wear scar diameters of the blends were determined at 1800 rpm and 40 kg for five minutes. The wear data are recorded in Table III. The scar diameter of the oil containing a mixture of 0.25% $Sb_2S_4$ and 0.25% $MoS_2$ is smaller than that of the oil samples containing either 0.5% $Sb_2S_4$ or 0.5% $MoS_2$ alone.

TABLE III

Shell Four-Ball Wear Scar Diameters[1] of a Mineral Oil Containing Additives

| Example | Oil Composition | Scar Diameter |
|---|---|---|
| 13 | 0.5% $Sb_2S_4$ in base oil[2] | 0.54 |
| 14 | 0.25% $Sb_2S_4$ and 0.25% $MoS_2$ in base oil | 0.43 |
| 15 | 0.5% $MoS_2$ in base oil | 0.53 |

[1]1800 rpm and 40 kg for five minutes (AISI 52100 steel balls).
[2]The base oil is bright stock mineral oil with 2600 SUS viscosity at 100° F.

EXAMPLES 16 THROUGH 18

In addition to the EP and antiwear properties, another desirable characteristic of a lubricant additive is to provide low coefficient of friction. This series of experiments is to determine whether a mixture of $Sb_2S_4$ and $MoS_2$ in a mineral oil can produce coefficient of friction lower than that of the single components. A paraffinic mineral oil having a viscosity of 155 SUS at 100° F. was separately blended with different amounts of $SbSbS_4$ and $MoS_2$ as indicated in Table IV in the presence of a succinimide type suspending agent. The coefficients of friction of these blends were obtained on a Shell Four-Ball Wear Tester with a torque measuring attachment. The results are recorded in Table IV. It is interesting to note that the oil blend containing the mixture of $Sb_2S_4$ and $MoS_2$ produced the lowest coefficient of friction among the three blends.

TABLE IV

Coefficients of Friction of a Mineral Oil Containing Additives[1]

| Example | Oil Composition | Coefficient of Friction |
|---|---|---|
| 16 | 0.5% $Sb_2S_4$ in base oil | 0.04 |
| 17 | 0.25% $Sb_2S_4$ and 0.25% $MoS_2$ in base oil | 0.01 |
| 18 | 0.5% $MoS_2$ in base oil | 0.04 |

[1]Coefficients of friction were obtained at 1200 rpm and 40 kg for five minutes (AISI 52100 steel balls).

What is claimed:

1. A lubricating composition consisting essentially of, by weight, from about 60 to about 99.8% of a lubricant selected from the group consisting of a grease, a mineral oil of lubricating viscosity, and a synthetic fluid of lubricating viscosity and a synergistic mixture of from about 0.1 to about 20% of $SbSbS_4$ and from about 0.1 to about 20% of a member selected from $MoS_2$ or graphite wherein said $SbSbS_4$ and said member are in a ratio of from about 1 to 9 to 9 to 1.

2. The lubricating composition of claim 1 wherein the lubricant is selected from a silica grease, a clay grease, a lithium grease, or an aluminum complex grease.

3. The lubricating composition of claim 2 wherein said mixture is 7.5% of $SbSbS_4$ and 2.5% of $MoS_2$.

4. The composition of claim 2 wherein said mixture is 5% of $SbSbS_4$ and 5% of $MoS_2$.

5. The composition of claim 2 wherein said mixture is 6.7% of $SbSbS_4$ and 3.3% of graphite.

6. The composition of claim 1 wherein the lubricant is a mineral oil of lubricating viscosity or a synthetic fluid of lubricating viscosity.

7. The composition of claim 6 wherein the additive mixture is 0.25% of $SbSbS_4$ and 0.25% of $MoS_2$.

* * * * *